US006255925B1

(12) United States Patent
DiMarco et al.

(10) Patent No.: US 6,255,925 B1
(45) **Date of Patent: *Jul. 3, 2001**

(54) THERMAL-MAGNETIC TRIP UNIT WITH ADJUSTABLE MAGNETIC TRIPPING

(75) Inventors: Bernard DiMarco, Lilburn; Charles D. Garnto, Buford, both of GA (US)

(73) Assignee: Siemens Energy & Automation, Inc., Alpharetta, GA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/507,551

(22) Filed: Feb. 18, 2000

(51) Int. Cl.[7] ..... H01H 9/00
(52) U.S. Cl. ..... 335/176; 335/45
(58) Field of Search ..... 335/23–25, 35, 335/38, 42, 43, 44, 45, 167–176

(56) References Cited

U.S. PATENT DOCUMENTS

| | | | | |
|---|---|---|---|---|
| 3,936,780 | * | 2/1976 | Hennemann | 335/23 |
| 4,488,133 | | 12/1984 | McClellan et al. | 335/16 |
| 4,922,220 | * | 5/1990 | Livessey et al. | 335/45 |
| 4,958,136 | * | 9/1990 | Maier et al. | 335/42 |
| 5,467,069 | * | 11/1995 | Payet-burin et al. | 335/42 |
| 5,534,835 | | 7/1996 | McColloch | 335/172 |
| 5,926,081 | | 7/1999 | DiMarco et al. | 335/16 |
| 5,982,258 | * | 11/1999 | Baginski et al. | 335/175 |

* cited by examiner

*Primary Examiner*—Lincoln Donovan
*Assistant Examiner*—Tuyen T. Nguyen

(57) ABSTRACT

An adjustable thermal-magnetic trip unit for a molded case circuit breaker 10 is disclosed, with the circuit breaker 10 including a housing 12 having an operating mechanism 40 including an intermediate latch 52, a line terminal 18, a load terminal 16 and a cover 20. The adjustable thermal-magnetic trip unit includes a magnetic yoke 66 mounted in the housing 12, and a bimetal member mounted in the magnetic yoke 66, with the bimetal member having a fixed end and a movable end. The fixed end is coupled to a load bus 61 of the load terminal 16, and the movable end is coupled to a movable contact of the operating mechanism 40. The trip unit 610 also includes a horizontal trip bar rotatably mounted in the housing 12, with the trip bar 54 having an actuating arm gapped from the movable end of the bimetal member and with the actuating arm aligned to selectively engage the movable end of the bimetal member. The trip unit 610 also includes a latch pawl mounted on the trip bar 54 and having an inclined latching surface aligned with and engaging an inclined latch surface of the intermediate latch; and an adjustment knob associated with the trip bar, wherein rotation of the adjustment knob moves the trip bar horizontally and thereby moves the latch pawl along the inclined latching surface to change the gap between the actuating arm and the movable end of the bimetal member.

22 Claims, 12 Drawing Sheets

THERMAL-MAGNETIC TRIP UNIT WITH ADJUSTABLE MAGNETIC TRIPPING

FIELD OF THE INVENTION

The present invention relates generally to electrical circuit breakers, and more particularly to adjustability of trip thresholds.

BACKGROUND OF THE INVENTION

In general the function of a circuit breaker is to electrically engage and disengage a selected circuit from an electrical power supply. This function occurs by engaging and disengaging a pair of operating contacts for each phase of the circuit breaker. The circuit breaker provides protection against persistent overcurrent conditions and against the very high currents produced by short circuits. Typically, one of each pair of the operating contacts are supported by a pivoting contact arm while the other operating contact is substantially stationary. The contact arm is pivoted by an operating mechanism such that the movable contact supported by the contact arm can be engaged and disengaged from the stationary contact.

There are two modes by which the operating mechanism for the circuit breaker can disengage the operating contacts: the circuit breaker operating handle can be used to activate the operating mechanism; or a tripping mechanism, responsive to unacceptable levels of current carried by the circuit breaker, can be used to activate the operating mechanism. For many circuit breakers, the operating handle is coupled to the operating mechanism such that when the tripping mechanism activates the operating mechanism to separate the contacts, the operating handle moves to a fault or tripped position.

To engage the operating contacts of the circuit breaker, the circuit breaker operating handle is used to activate the operating mechanism such that the movable contact (s) engage the stationary contact(s). A motor coupled to the circuit breaker operating handle can also be used to engage or disengage the operating contacts. The motor can be remotely operated.

A typical industrial thermal-magnetic circuit breaker will have a continuous current rating ranging from as low as 15 amps to as high as 160 amps. The tripping mechanism for the breaker usually consists of a relatively quickly acting magnetic short circuit release, for larger overcurrents, including those of short duration, and a relatively slowly acting thermal overload release, for longer term and lower level overcurrents.

In the event of current levels above the normal operating level of the thermal overload release, it is desirable to trip the breaker without any intentional delay, as in the case of a short circuit in the protected circuit, therefore, an electromagnetic trip element is generally used. In a short circuit condition, the higher amount of current flowing through the circuit breaker activates a magnetic release which trips the breaker in a much faster time than occurs with the bi-metal heating. It is desirable to tune the magnetic trip elements so that the magnetic trip unit trips at lower short circuit currents at a lower continuous current rating and trips at a higher short circuit current at a higher continuous current rating. This matches the current tripping performance of the breaker with the typical equipment present downstream of the breaker on the load side of the circuit breaker.

The thermal overload release operates by means of a bimetallic element, in which current flowing through the conducting path of a circuit breaker generates heat in the bi-metal element, which causes the bi-metal to deflect and trip the breaker. The heat generated in the bi-metal is a function of the amount of current flowing through the bi-metal as well as for the period of time that that current is flowing. For a given range of current ratings, the bi-metal cross-section and related elements must be specifically selected for such current range resulting in a number of different circuit breakers for each current range.

It is known to provide for a thermal-magnetic circuit breaker to include a thermal trip adjustment capability, wherein the time and/or overcurrent tripping characteristics of the circuit breaker, and thereby the current rating of the circuit breaker, can be adjusted by a worker in the field. But only some field applications require thermal adjustment capability. Other field applications require a fixed, non-adjustable tripping means. It would be advantageous to provide for a thermal-magnetic circuit breaker to include an optional thermal adjustment feature, so that the adjustment capability may be removed, disabled, or enabled by the manufacturer. It would also be advantageous for a circuit breaker having an optional thermal adjustment feature to require changing or replacing of relatively few parts to remove, disable, or enable the thermal adjustment feature. It would further be advantageous for a circuit breaker having an optional thermal adjustment feature to utilize a single set of tooling for producing a housing and cover for the circuit breaker, and to utilize relatively inexpensive tool accessories such as inserts and plugs for adapting the tooling to produce circuit breaker housings and covers with and without a thermal adjustment feature.

SUMMARY OF THE INVENTION

The present invention provides an adjustable thermal-magnetic trip unit for a molded case circuit breaker, with the circuit breaker including a housing having an operating mechanism including an intermediate latch, a line terminal, a load terminal and a cover. The adjustable thermal-magnetic trip unit includes a magnetic yoke mounted in the housing, and a bimetal member mounted in the magnetic yoke, with the bimetal member having a fixed end and a movable end, with the fixed end coupled to a load bus of the load terminal and the movable end coupled to a movable contact of the operating mechanism. The trip unit also includes a trip bar extending along a horizontal axis and rotatably mounted in the housing, with the trip bar having an actuating arm positioned with a gap from the movable end of the bimetal member and with the actuating arm aligned to selectively engage the movable end of the bimetal member; a latch pawl mounted on the trip bar, with the latch pawl having an inclined latching surface aligned with and engaging an inclined latch surface of the intermediate latch; and an adjustment knob associated with the trip bar, with the adjustment knob having an eccentric pin aligned with a slot in the trip bar, wherein the rotation of the adjustment knob imparts a lateral position motion to the trip bar along the horizontal axis thereby moving the latch pawl along the inclined latching surface to change the gap between the actuating arm and the movable end of the bimetal member.

Another embodiment of the present invention provides a molded case circuit breaker including a molded housing provided with a breaker cover and base, a first terminal and a second terminal mounted in the base, a contact electrically coupled to the first terminal, and a moveable contact electrically coupled to the second terminal. The circuit breaker also includes an operating mechanism having a pivoting member moveable between an ON position, an OFF position and a TRIPPED position, wherein the pivoting member is coupled to the moveable contact; an intermediate latching mechanism mounted in the housing and coupled to the operating mechanism; and an adjustable thermal-magnetic trip unit. The trip unit includes a magnetic yoke mounted in the housing; a bimetal member mounted in the magnetic yoke, with the bimetal member having a fixed end and a movable end, with the fixed end coupled to a load bus of the second terminal and the movable end coupled to the movable contact of the operating mechanism; a trip bar extending along a horizontal axis and rotatably mounted in the housing, with the trip bar having an actuating arm positioned with a gap from the movable end of the bimetal member and with the actuating arm aligned to selectively engage the movable end of the bimetal member; a latch pawl mounted on the trip bar, with the latch pawl having an inclined latching surface aligned with the intermediate latch; and an adjustment knob associated with the trip bar, with the adjustment knob having an eccentric pin aligned with a slot in the trip bar, wherein rotation of the adjustment knob imparts a lateral position motion to the trip bar along the horizontal axis thereby moving the latch pawl along the inclined latching surface to change the gap between the actuating arm and the movable end of the bimetal member.

Another embodiment of the present invention provides a circuit breaker provided with a housing including a base, a means for connecting a load to the breaker, mounted in the housing; and a means for connecting an electrical line to the breaker, mounted in the housing. The circuit breaker also includes a stationary contact electrically coupled to the means for connecting an electrical line, and a moveable contact coupled to a means for operating mounted in the housing and having a pivoting member moveable between an ON position and OFF position, and a TRIPPED position, with the pivoting member coupled to the moveable contact and with the means for operating coupled to an intermediate means for latching the means for operating. The present invention further includes a means for tripping coupled to the moveable contact and the means for connecting a load with the means for tripping in selective operative contact with the intermediate means for latching, and a means for adjusting a characteristic of the means for tripping, wherein the means for tripping will trip the circuit breaker.

DETAILED DESCRIPTION OF THE PREFERRED EMBODIMENTS

Figure 1A:
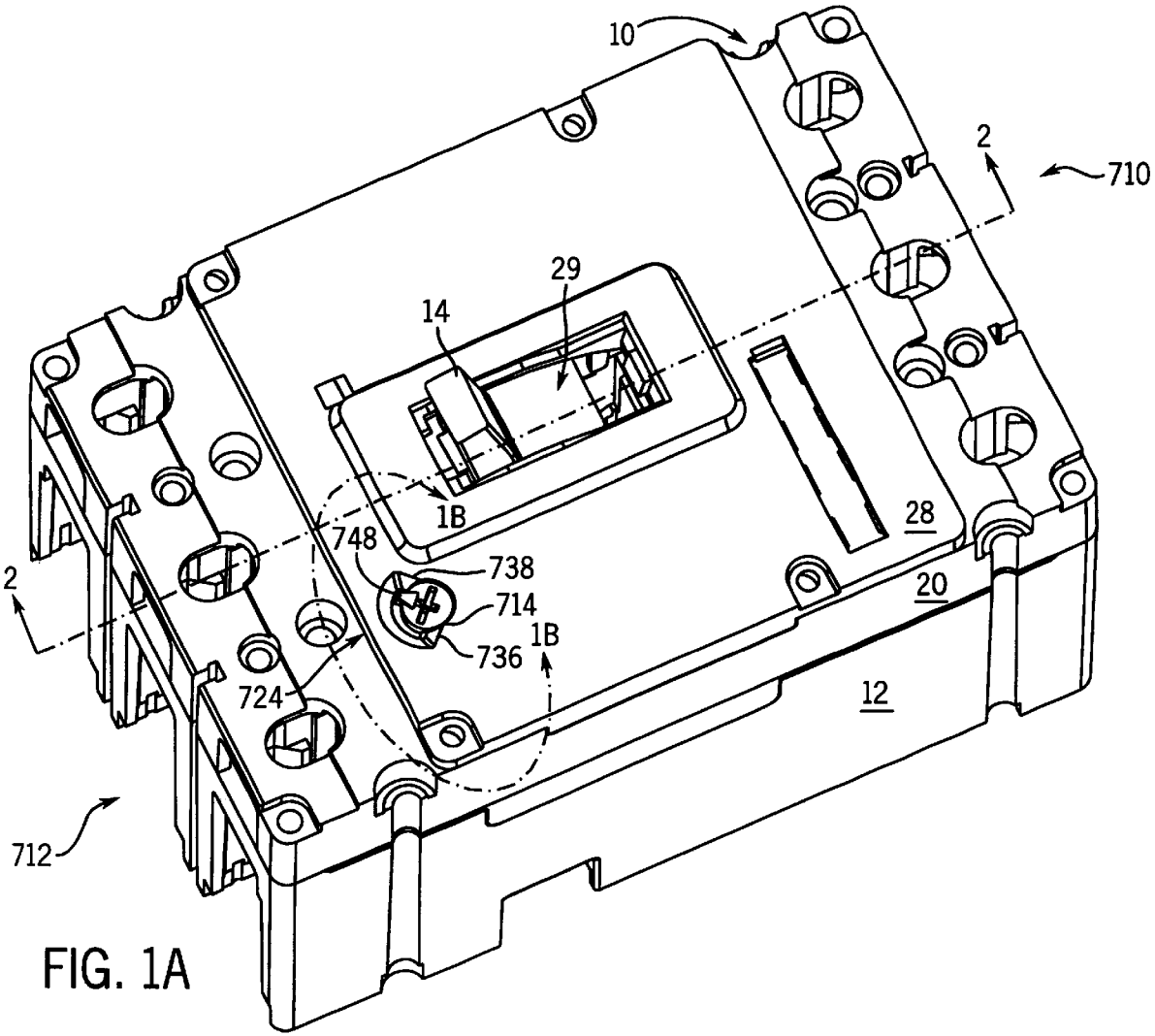
FIG. 1A is a perspective view of a molded case circuit breaker which includes an embodiment of the present thermal adjustment feature.
Figure 1B:
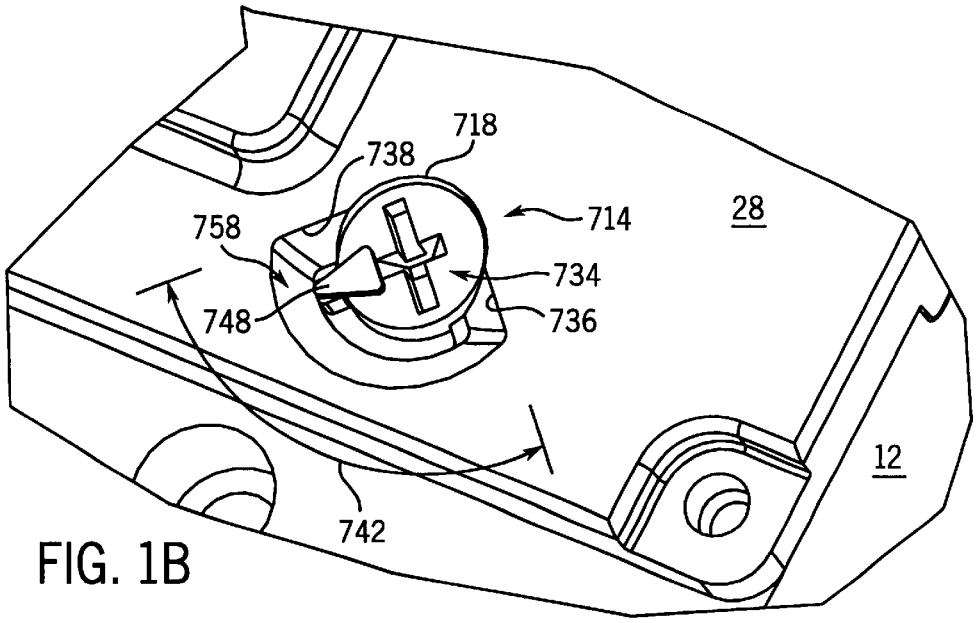
FIG. 1B is an enlarged fragmentary view of a portion of a cover of the circuit breaker shown in FIG. 1A, showing a thermal adjustment knob.

FIG. 1 generally illustrates a three phase molded case circuit breaker 10 of the type which includes an operating mechanism 40 having a pivoting member 13 with a handle 14. The pivoting member 13 and handle 14 are moveable between an ON position, an OFF position, and a TRIPPED position. The exemplary circuit breaker 10 is a three pole breaker having three sets of contacts for interrupting current in each of the three respective electrical transmission phases. In the exemplary embodiment of the invention, each phase includes separate breaker contacts and a separate trip mechanism. The center pole circuit breaker includes an operating mechanism which controls the switching of all three poles of the breaker. Although an embodiment of the present invention is described in the context of the three phase circuit breaker, it is contemplated that it may be practiced in a single phase circuit breaker or in other multi-phase circuit breakers.

Circuit breaker 10 also includes a thermal adjustment apparatus 708, described below, which includes an adjusting knob 714 and an accessory cover 28*a* having an opening 718 to receive knob 714. As best shown in FIG. 1A, knob 714 is conventionally configured device including a radial protrusion shown as a pointer 748 and a tool engagement feature, shown as a screwdriver slot 734. Opening 718 is preferably molded in accessory cover 28*a*, and includes an arcuate relief configured to receive pointer 748 while knob 714 is rotated over a range of positions subtending an angle 742. Opening 718 includes two radially disposed (with respect to an axis of rotation of knob 714) walls, positioned to define the beginning and the end of angle 742 (i.e., to serve as a "low" stop 736 and a "high" stop 738 for pointer 748 of knob 714). As described below, knob 714 and opening 718 are generally configured to cooperate with trip bar 54 to include and define a particular range of thermal-magnetic characteristics (i.e., time and magnitude of overcurrent) for circuit breaker 10.

Figure 2:
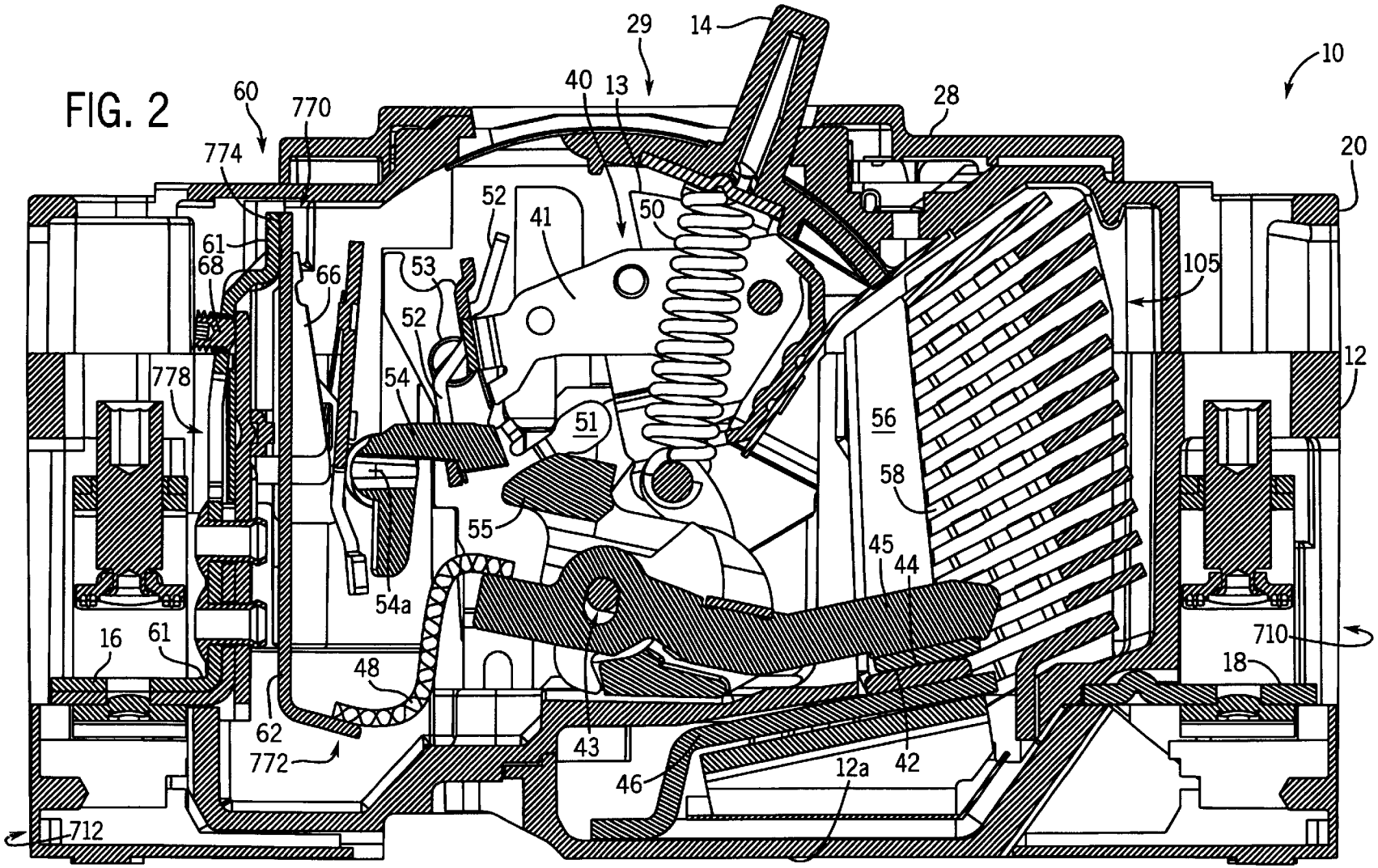
FIG. 2 is a section view of the circuit breaker shown in FIG. 1 along the line 2—2 and is used to describe the operation of the circuit breaker.
Figure 4:
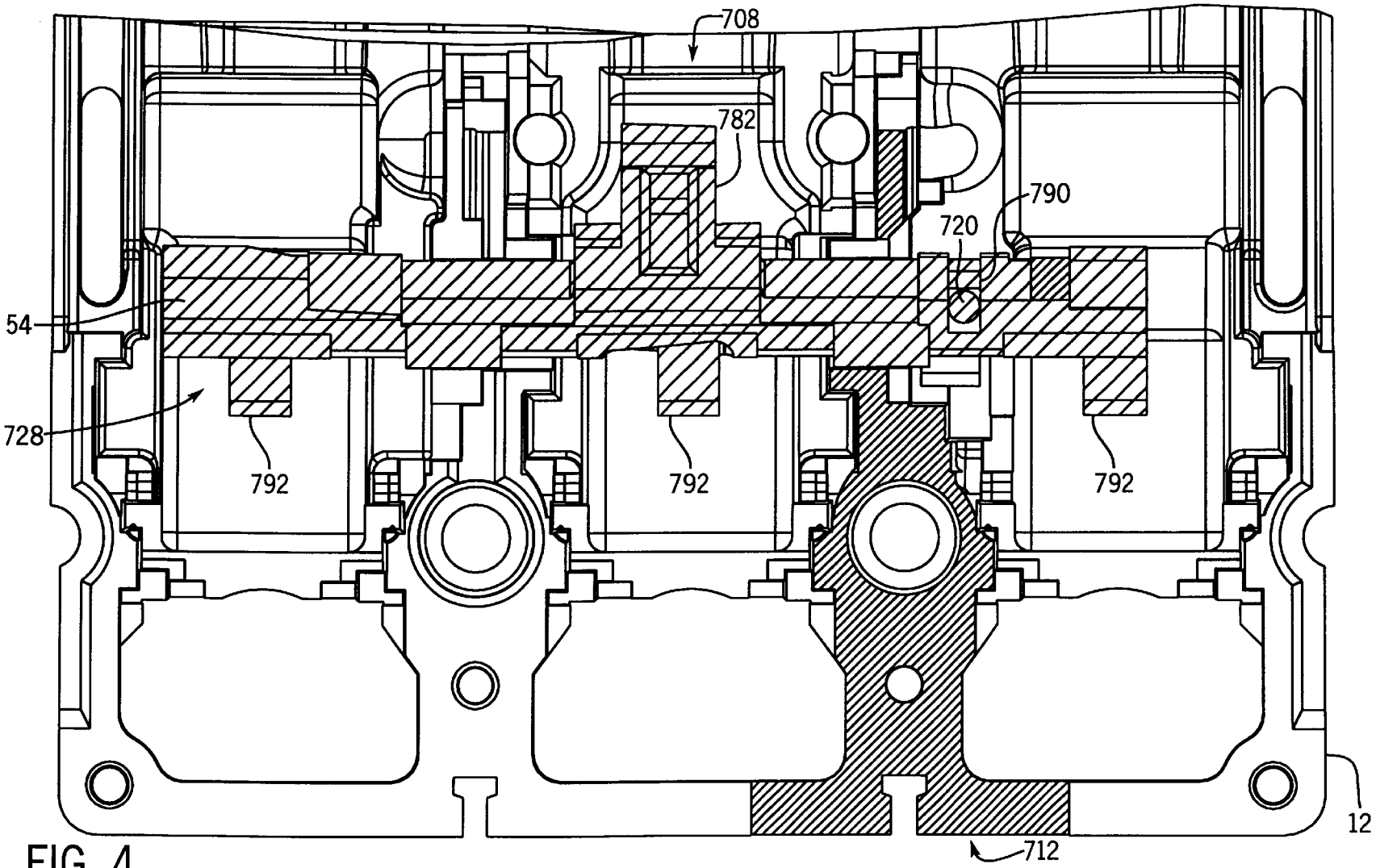
FIG. 4 is a partial top view of a base of the circuit breaker shown in FIG. 1 with the cover removed, illustrating an installed trip bar.

Referring now to FIG. 2, handle 14 is operable between the ON and OFF positions to enable a contact operating mechanism 40 to engage and disengage a moveable contact 44 and a stationary contact 42 for each of the three phases, such that the line terminal 18 and load terminal 16 of each phase can be electrically connected. The circuit breaker housing 12 includes three portions which are molded from an insulating material. These portions include a circuit breaker base 12, a circuit breaker cover 20 and an accessory cover 28 with breaker cover 20 and the accessory cover 28 having an opening 29 for the handle 14 of the pivoting member 13. The pivoting member 13 and handle 14 move within the opening 29 during the several operations of the circuit breaker 10. FIG. 2 is a cut away view of the circuit breaker 10 along the lines 2—2 shown in FIG. 1. As shown in FIG. 2, the main components of the circuit breaker are a fixed line contact arm 46 and a moveable load contact arm 45. It should be noted that another embodiment of the circuit breaker 10 has a movable line contact arm to facilitate a faster current interruption action. The load contact arms for each of the three phases of the exemplary breaker are mechanically connected together by an insulating cross bar member 55. This cross bar member 55, in turn, is mechanically coupled to the operating mechanism 40 so that, by moving the handle 14 from left to right, the cross bar 55 rotates in a clockwise direction and all three load contact arms 45 are concurrently moved to engage their corresponding line contact arms 46, thereby making electrical contact between moveable contact pad 42 and stationary contact pad 44.

The operating mechanism 40 includes a cradle 41 which engages an intermediate latch 52 to hold the contacts of the circuit breaker in a closed position unless and until an over current condition occurs, which causes the circuit breaker to trip. A portion of the moveable contact arm 45 and the stationary contact bus 46 are contained in an arc chamber 56. Each pole of the circuit breaker 10 is provided with an arc chamber 56 which is molded from an insulating material and is part of the circuit breaker 10 housing 12. A plurality of arc plates 58 is maintained in the arc chamber 56. The arc plates facilitate the extension and cooling of the arc formed when the circuit breaker 10 is opened while under a load and drawing current. The arc chamber 56 and arc plates 58 direct the arc away from the operating mechanism 40.

The exemplary intermediate latch 52 is generally Z-shaped having an upper leg which includes a latch surface that engages the cradle 41 and a lower leg having a latch surface which engages a trip bar 54. The center portion of the Z-shaped intermediate latch element 52 is angled with respect to the upper and lower legs and includes two tabs which provide a pivot edge for the intermediate latch 52 when it is inserted into the mechanical frame 51. As shown in FIG. 2, the intermediate latch 52 is coupled to a torsion spring 53 which is retained in the mechanical frame 51 by the mounting tabs of the intermediate latch 52. The torsion spring 53 biases the upper latch surface of the intermediate latch 52 toward the cradle 41 while at the same time biasing the trip bar 54 into a position which engages the lower latch surface of the intermediate latch 52. The trip bar 54 pivots in a counter clockwise direction about an axis 54*a*, responsive to a force exerted by a bimetallic element 62, during, for example, a long duration over current condition. As the trip bar 54 rotates, in a counter clockwise direction, the latch surface on the upper portion of the trip bar disengages the latch surface on the lower portion of the intermediate latch 52. When this latch surface of the intermediate latch 52 is disengaged, the intermediate latch 52 rotates in a counter clockwise direction under the force of the operating mechanism 40, exerted through a cradle 41. In the exemplary circuit breaker, this force is provided by a tension spring 50. Tension is applied to the spring when the breaker toggle handle 14 is moved from the open position to the closed position. More than one tension spring 50 may be utilized.

As the intermediate latch 52 rotates responsive to the upward force exerted by the cradle 41, it releases the latch on the operating mechanism 40, allowing the cradle 41 to rotate in a clockwise direction. When the cradle 41 rotates, the operating mechanism 40 is released and the cross bar 55 rotates in a counter clockwise direction to move the load contact arms 45 away from the line contact arms 46.

During normal operation of the circuit breaker, current flows from the line terminal 18 through the line contact arm 46 and its stationary contact pad 44 to the load contact arm 45 through its contact pad 42. From the load contact arm 45, the current flows through a flexible braid 48 to the bimetallic element 62 and from the bimetallic element 62 to the load terminal 16. (See FIG. 3) When the current flowing through the circuit breaker exceeds the rated current for the breaker, it heats the bimetallic element 62, causing the element 62 to bend towards the trip bar 54. If the over current condition persists, the bimetallic element 62 bends sufficiently to engage the trip bar surface. As the bimetallic element engages the trip bar surface and continues to bend, it causes the trip bar 54 to rotate in a counter clockwise direction releasing the intermediate latch 52 and thus unlatching the operating mechanism 40 of the circuit breaker.

Figure 3:
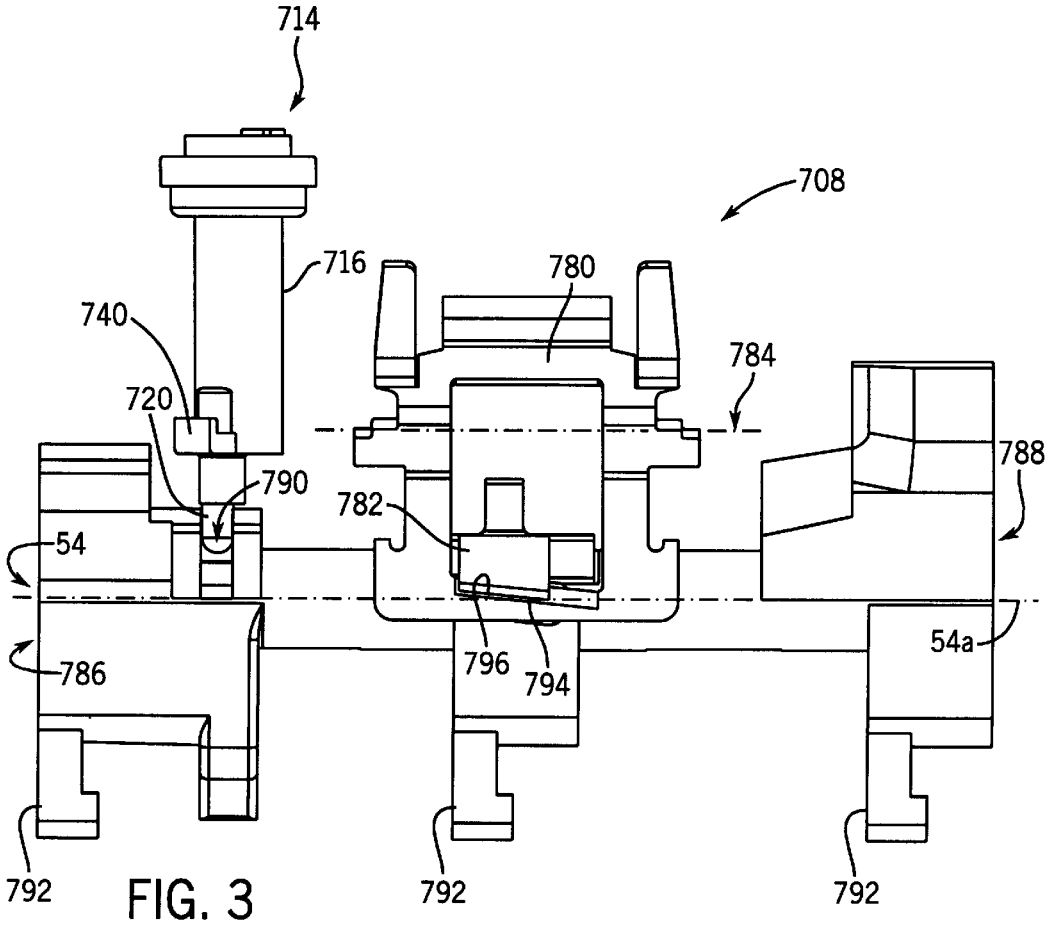
FIG. 3 is an elevation view of a thermal adjusting knob, trip bar, and latch of the circuit breaker shown in FIG. 1.

FIG. 3 is an exploded isometric drawing which illustrates the construction of a portion of the circuit breaker shown in FIG. 2. In FIG. 3 only the load contact arm 45 of the center pole of the circuit breaker is shown. This load contact arm 45 as well as the contact arms for the other two poles, are fixed in position in the cross bar element 55. As mentioned above, additional poles, such as a four pole molded case circuit breaker can utilize the same construction as described herein, with the fourth pole allocated to a neutral. The load contact arm 45 is coupled to the bimetallic element 62 by a flexible conductor 48 (e.g. braided copper strand). As shown in FIG. 3, current flows from the flexible conductor 48 through the bimetallic element 62 to a connection at the top of the bimetallic element 62 which couples the current to the load terminal 16 through the load bus 61. The load bus 61 is supported by a load bus support 63. It should be noted that more than one flexible conductor 48 may be utilized.

In the exemplary circuit breaker 10, the cross bar 55 is coupled to the operating mechanism 40, which is held in place in the base or housing 12 of the molded case circuit breaker 10 by a mechanical frame 51. The key element of the operating mechanism 40 is the cradle 41. As shown in FIG. 3, the cradle 41 includes a latch surface 41*a* which engages the upper latch surface in the intermediate latch 52. The intermediate latch 52 is held in place by its mounting tabs which extend through the respective openings 51*a* on either side of the mechanical frame 51. In the exemplary embodiment of the circuit breaker, the two side members of the mechanical frame 51 support the operating mechanism 40 of the circuit breaker 10 and retain the operating mechanism 40 in the base 12 of the circuit breaker 10.

The breaker cover 20, in the preferred embodiment, has two accessory sockets 22 formed in the cover 20, with one accessory socket 22 on either side of the opening 29 for the pivoting member 13 and handle 14. The breaker cover 20 with the accessory sockets 22 or compartments can be formed, usually by well known molding techniques, as an integral unit. The accessory socket 22 can also be fabricated separately and attached to the breaker cover 20 by any suitable method such as with fasteners or adhesives. The breaker cover 20 is sized to cover the operating mechanism 40, the moveable contact 42 and the stationary contact 44, as well as the trip mechanism 60 of the circuit breaker 10. The breaker cover has an opening 29 to accommodate the handle 14.

Each accessory socket or compartment 22 is provided with a plurality of openings 24. The accessory socket openings 24 are positioned in the socket 22 to facilitate coupling of an accessory 80 with the operating mechanism 40 mounted in the housing 12. The accessory socket openings 24 also facilitate simultaneous coupling of an accessory 80 with different parts of the operating mechanism 40. Various accessories 80 can be mounted in the accessory compartment 22 to perform various functions. Some accessories, such as a shunt trip, will trip the circuit breaker 10, upon receiving a remote signal, by pushing the trip bar 54, causing release of the mechanism latch 52 of the operating mechanism 40. The shunt trip has a member protruding through one of the openings in the accessory socket 22 and engages the operating mechanism 40, via the trip bar 54. Another accessory, such as an auxiliary switch, provides a signal indicating the status of the circuit breaker 10, e.g. "on" or "off". When the auxiliary switch is nested in the accessory socket 22, a member on the switch assembly protrudes through one of the openings 24 in the socket 22 and is in engagement with the operating mechanism 40, typically the cross bar 55. Multiple switches can be nested in one accessory socket 22 and each switch can engage the operating mechanism via a common actuating arm through opening 24 in the socket 22.

FIG. 3 shows thermal adjustment apparatus 708. Thermal adjustment apparatus 708 includes thermal adjustment knob 714, adjustable trip bar 54, inclined trip bar surface 794, and inclined latch surface 796, which is configured to abut and cooperate with inclined trip bar surface 794.

Knob 714 includes a main shaft portion 716, a first end 714*a* having a tool recess 734 and a pointer 748 described above, a second end 714 *b* opposite first end 714*a* and provided with an eccentric pin 720 extending longitudinally therefrom; and a retention hook 740. Knob 714 is secured to accessory cover 28*a* by engagement of retaining hook 740 with an arcuate groove 744 (shown in FIG. 8B) and a compression coil spring 798 (shown in FIG. 7)

Eccentric pin 720 is maintained in engagement with a slot 790 of trip bar 54 configured to receive eccentric pin 720. Rotation of knob 714 over the arc 742 defined by opening 718 low stop 736 and high stop 738 (shown in FIG. 1A) translates trip bar 54 a predetermined and corresponding laterally disposed distance. The slope of inclined surface 794 of trip bar 54 is in predetermined correspondence to the lateral position of trip bar 54, and causes a partial and predetermined rotation of trip bar 54 (in correspondence to its distance of translation) with respect to other members of circuit breaker 10, those members including load bus 778 and bimetallic strip 62 (best shown in FIG. 5). This adjusts a gap 776 between a thermal actuator arm 792 and a free end 772 of bimetallic strip 62 at any given temperature; e.g., ambient air temperature when circuit breaker 10 is not operatively transmitting electricity.

Figure 5:
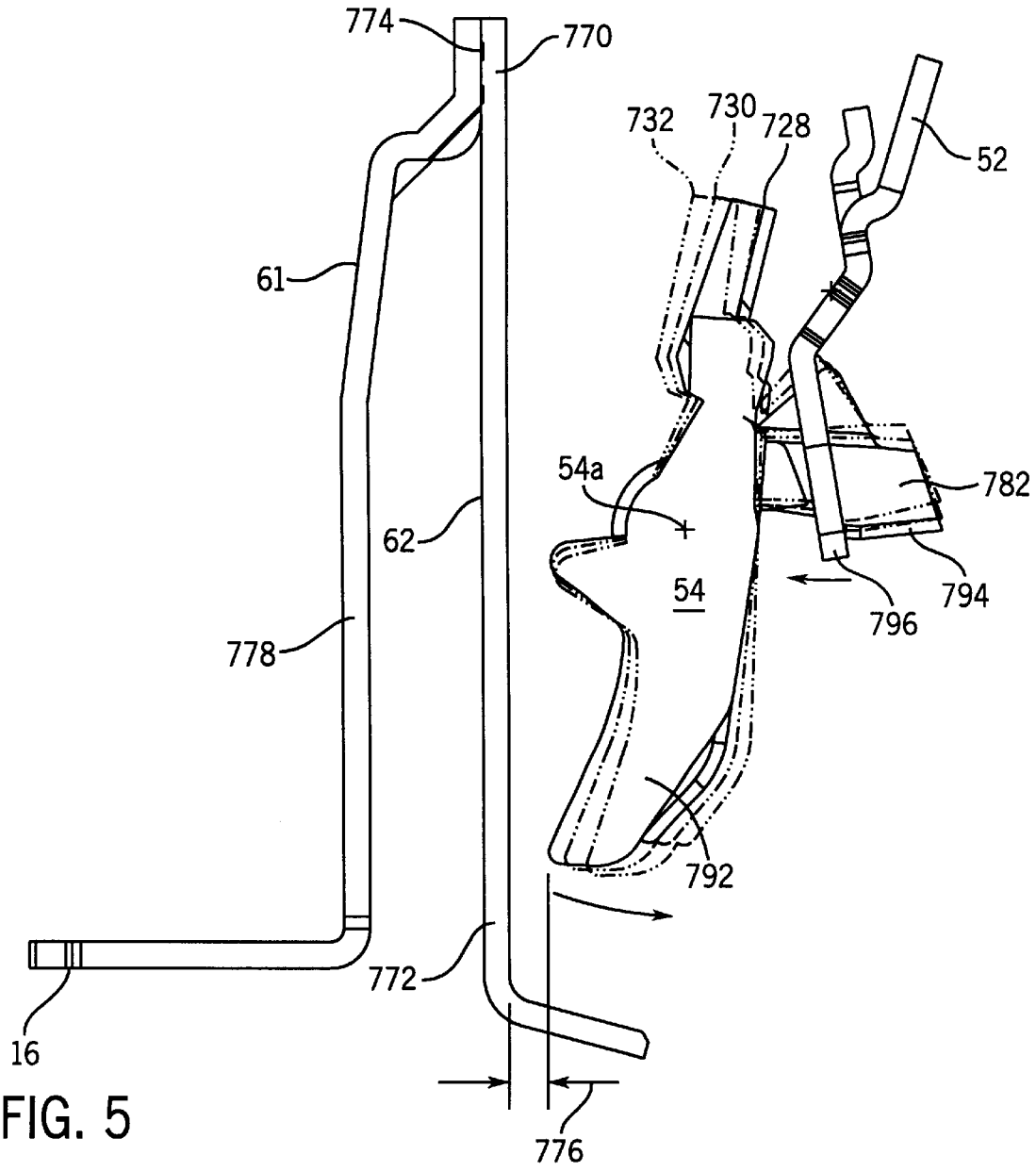
FIG. 5 is a fragmented elevation of a bimetallic element and a trip bar of the circuit breaker shown in FIG. 1.
Figure 6:
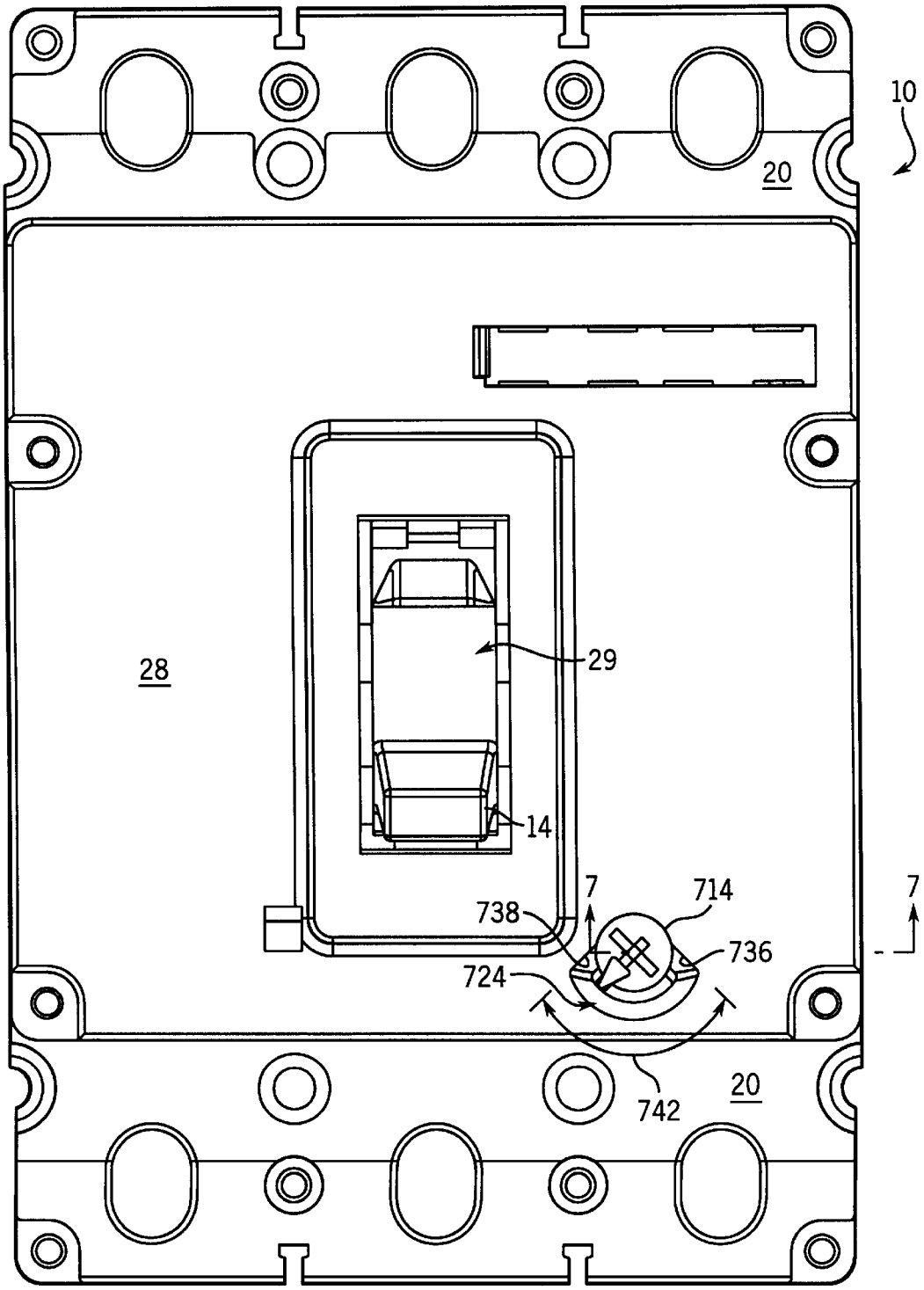
FIG. 6 is a top view of a cover for the circuit breaker shown in FIG. 1.

Bimetallic strip 62 has a fixed end 770 and free end 772. As is well known to those of skill in the art, a free end of a bimetallic strip moves a particular distance in correspondence with a particular change in temperature; i.e., gap 776 decreases in proportion to temperature change when disposed as shown in FIG. 5. Gap 776 can thereby be adjusted by knob 714 over a predetermined range of dimensions corresponding to a predetermined range of overcurrent magnitude and/or duration conditions. A "low" setting of knob 714 (i.e., with pointer 748 abutting low stop 736) in FIG. 1A causes a "low" position 728 of trip bar 54 in FIG. 5. Similarly, an intermediate setting of knob 714 places trip bar 54 in intermediate position 730, and a high setting of knob 714 (abutting high stop 738) places trip bar 54 in high position 732 of FIG. 5.

In a preferred embodiment, the current capacity adjustment range of circuit breaker 10 is determined by the manufacturer of circuit breaker 10 during the manufacturing process. This is done by adjusting a thermal calibration screw 68 threadedly engaged to load buss 61 and having an end bearing upon magnetic yoke 66 (shown in FIG. 2). This factory calibration is then locked or sealed (e.g., by tack welding, brazing, staking, otherwise deforming, or bonding the threads) to prevent further change of calibration (due, e.g., to vibration or accessing by an unknowledgeable worker).

Figure 7:
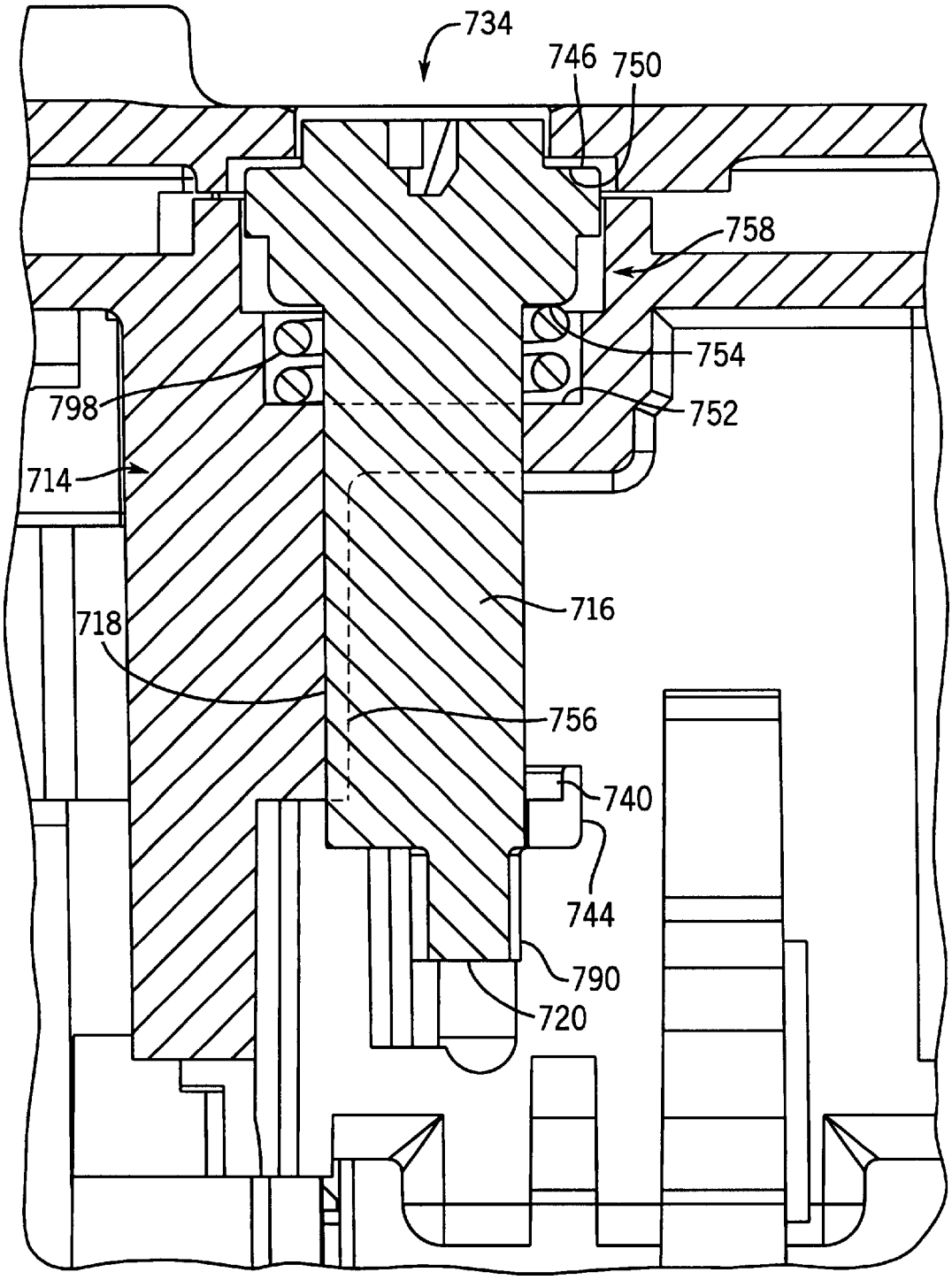
FIG. 7 is an enlarged fragmentary section of an adjusting knob of the circuit breaker shown in FIG. 1.

FIG. 7 shows more clearly the installation of knob 714 to cover 20 and accessory cover 28*a*. Spring 798 is compressed between a spring seat 752 of cover 20 and a spring seat 754 of knob 714, urging knob 714 out of opening 718 in cover 20. A retaining hook 740 of knob 714 is retained, however, by the cover 20 which has an arcuate groove 744 that allows the retaining hood 740 to rotate between the "high" and "low" positions. Pointer 748 is provided a longitudinal passage (not shown) along a side of opening 718 which allows knob 714 to be installed upon cover 20 in a particular rotational position not operatively reached later. Subsequent installation of accessory cover 28A prevents knob 714 from being returned to that rotational position, and knob 714 is thereby captivated to circuit breaker 10.

Tooling for molding or forming base 12, cover 20, and accessory cover 28A is costly. To provide a user-accessible thermal adjusting knob without requiring removal of a cover and possible exposure to line voltage, it is desirable to provide an exposed adjusting device such as knob 714. This, however, requires an opening in cover 20 and accessory cover 28A. FIGS. 8A through 8D show a method of reducing the tooling cost for providing dual versions of cover 20.

Figure 8A:
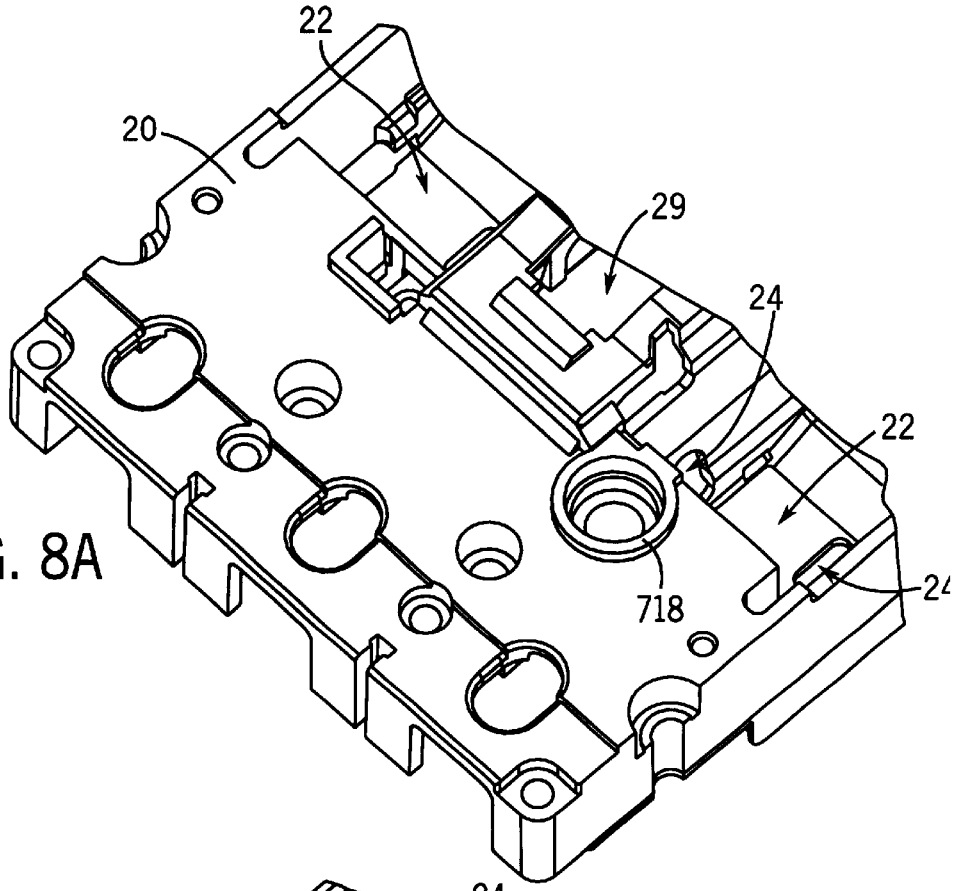
FIG. 8A is a perspective view of the outer surface of a cover of a thermally adjustable circuit breaker.
Figure 8B:
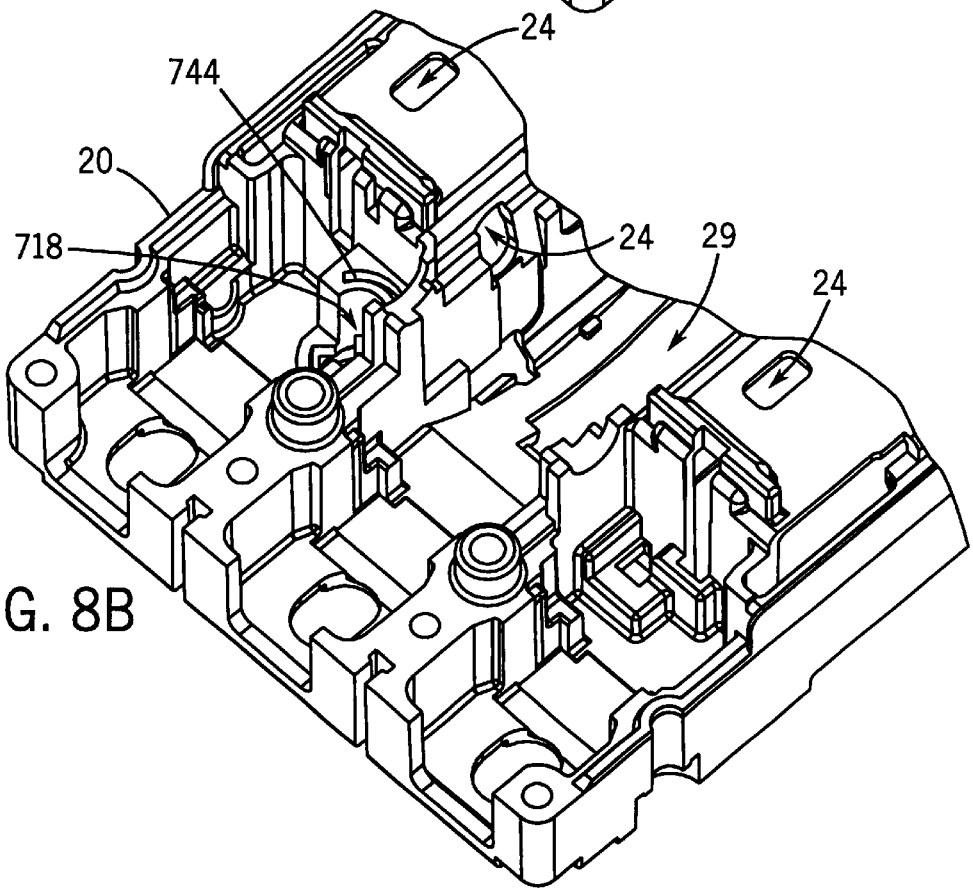
FIG. 8B is a perspective view of the inner surface of a cover of a thermally adjustable circuit breaker.

FIG. 8A shows the outer surface of a cover 20 intended for a circuit breaker 10 having a thermal adjustment capability. A removable plug is left in the mold, to form opening 718 as described above. FIG. 8B shows the inner surface of cover 20, wherein features of the removable plug cause the knob 14 bearing and retention features described above to be molded at the inner portion of cover 20. Inserts that would form walls in the way of lateral movement of trip bar 54 are left out of the mold, so that bearing features are molded to receive trip bar 54 without impediment to lateral movement of trip bar 54.

Figure 8C:
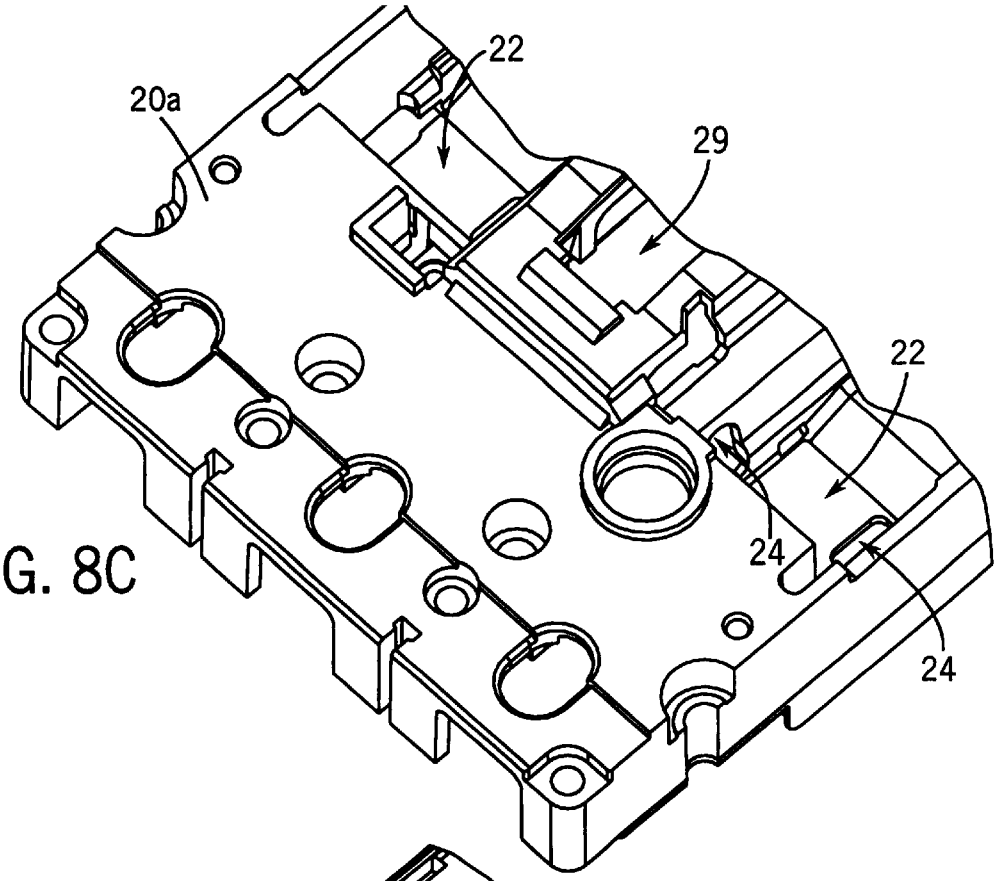
FIG. 8C is a perspective view of the outer surface of a cover of a thermally nonadjustable circuit breaker.
Figure 8D:
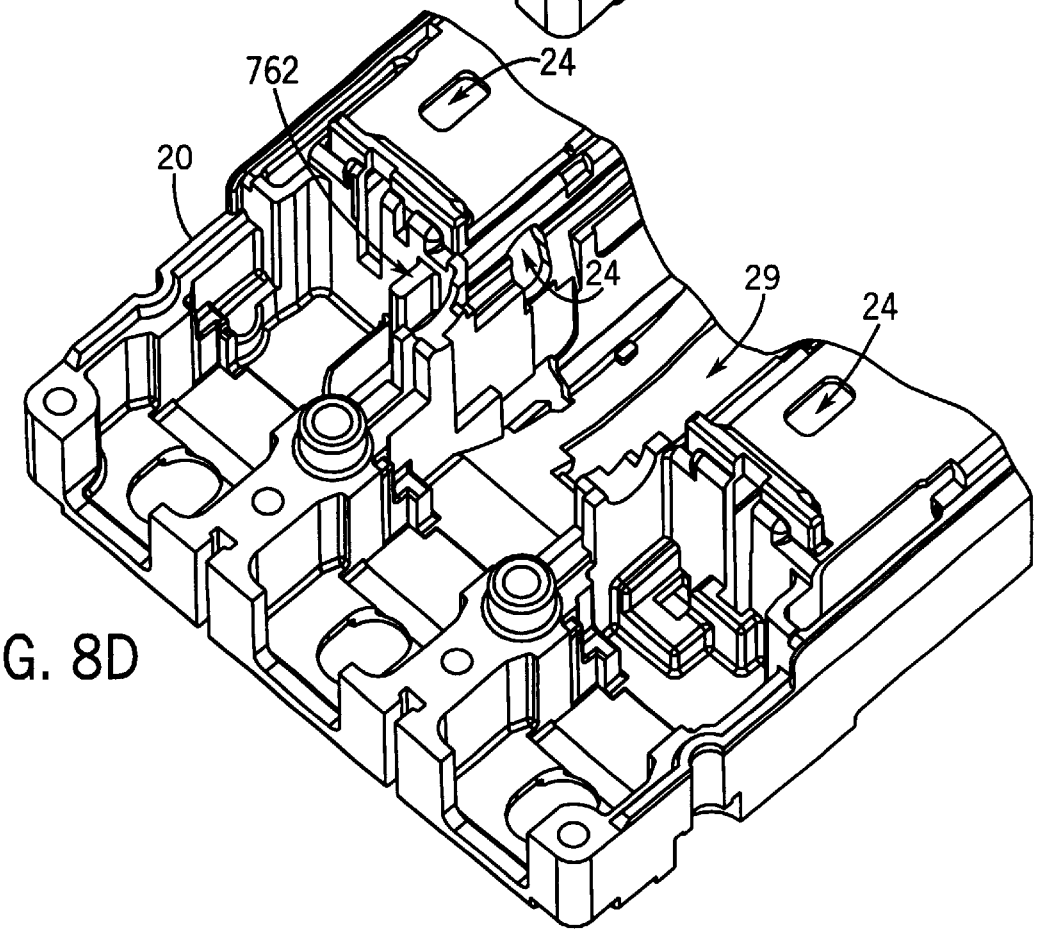
FIG. 8D is a perspective view of the inner surface of a cover of a thermally nonadjustable circuit breaker.
Figure 9:
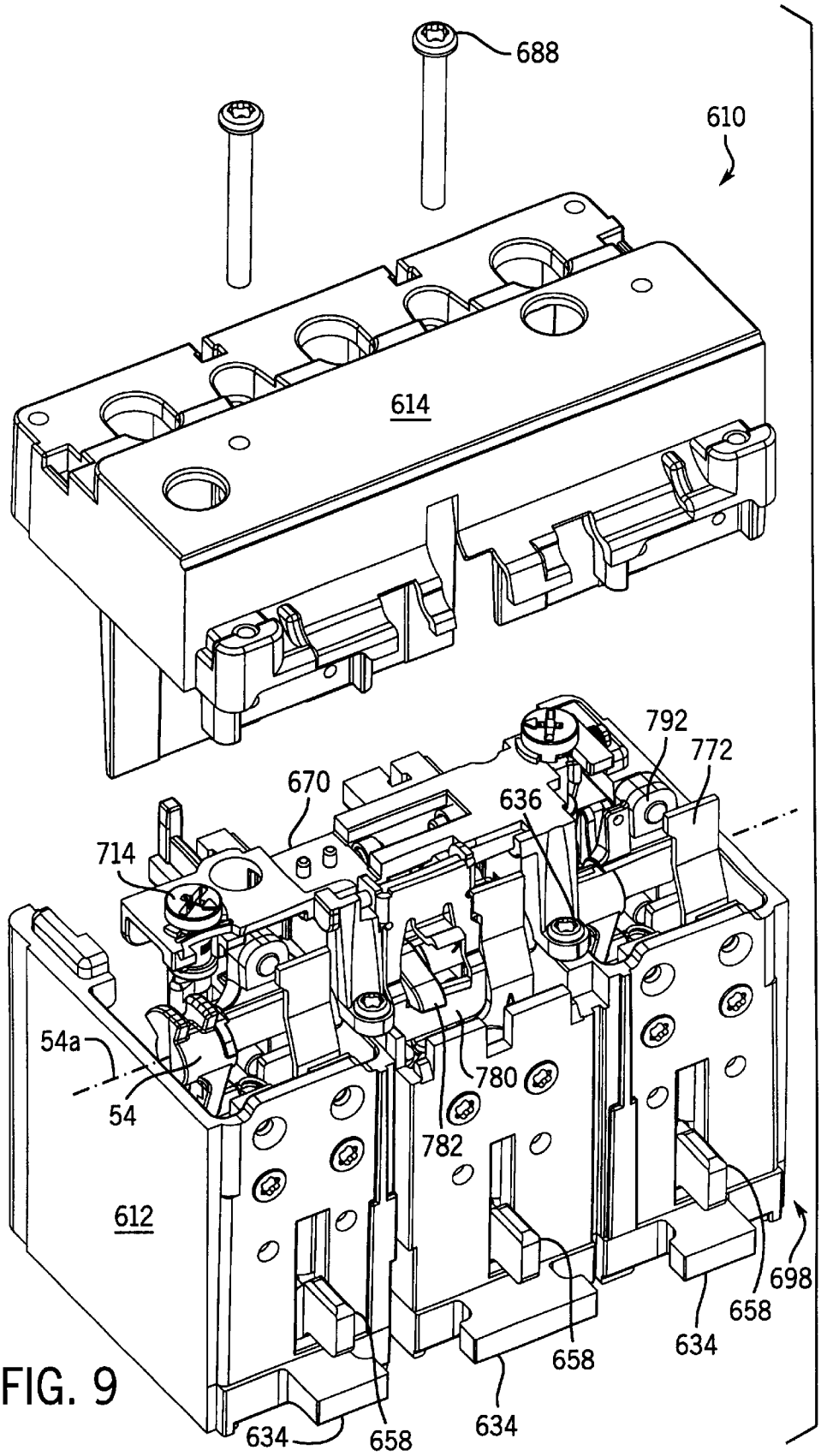
FIG. 9 is an exploded perspective view of the trip unit of the circuit breaker shown in FIG. 10.

FIG. 8C shows an exterior surface of a cover 20*a* intended for use with a circuit breaker 10*a*, having a thermal adjustment capability removed or disabled. A plug has been installed in the mold for producing covers 20 and 20*a*, filling the space where opening 718 would have been located and allowing deletion of a knob from circuit breaker 10*a*. In FIG. 8D, showing an interior surface of cover 20*a*, a different mold insert has been installed so that a wall 762 is formed for preventing any lateral motion of trip bar 54. In an alternative embodiment (not shown), opening 718 and knob 714 are provided but a protrusion on cover 20*a* or accessory cover 28*a* prevents knob 714 from being rotated.

Figure 10:
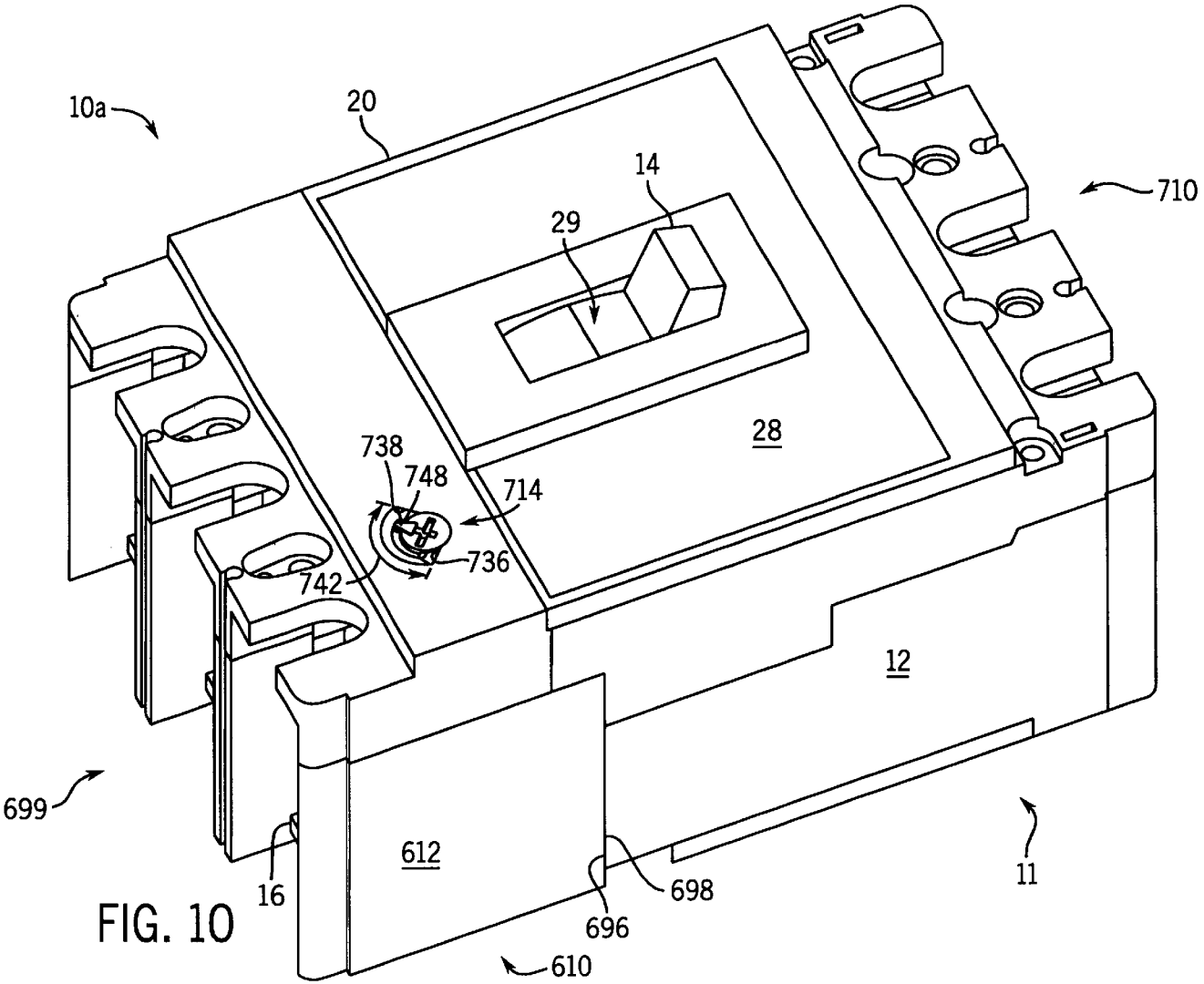
FIG. 10 is a perspective view of a thermally adjustable circuit breaker having a separable trip unit.

FIGS. 9 through 11B illustrate another alternative embodiment of circuit breaker 10, shown as a circuit breaker 10*a*. Circuit breaker 10*a*, best shown in FIG. 9, includes a breaker unit 11 and a separable trip unit 610. FIG. 10 shows trip unit 610 secured to breaker unit 11, and FIG. 11A shows trip unit 610 removed from breaker unit 11.

Breaker unit 11 includes a line terminal end 694, an interface end 696, a base 12, a cover 20, an accessory cover 28, a handle 14, an operating mechanism 40, an intermediate latch 52, and at least one line terminal 18. Trip unit 610 includes a load terminal end 699, an interface end 698, a base 612, a cover 614, a male electrical connector blade shown as a "stab" 658, a male mechanical connector member shown as a "dovetail" 634, at least one load terminal 16, and trip bar 54, and a thermal adjusting apparatus 708. Breaker unit 11 includes features (not shown) to receive stabs 658 and dovetails 634.

Figure 11A:
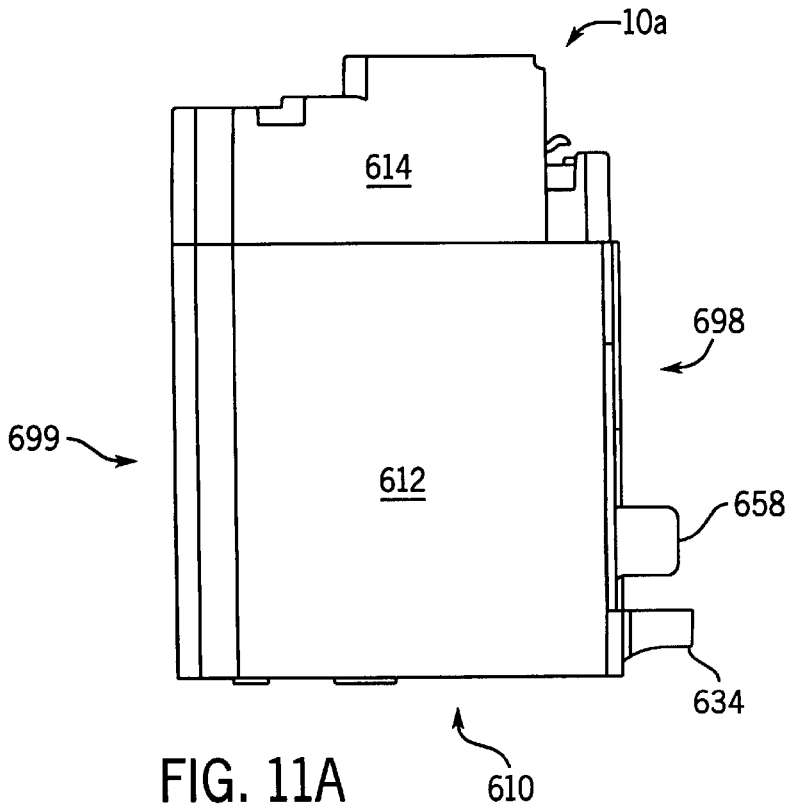
FIG. 11A is a side view of the trip unit of the circuit breaker shown in FIG. 10.
Figure 11B:
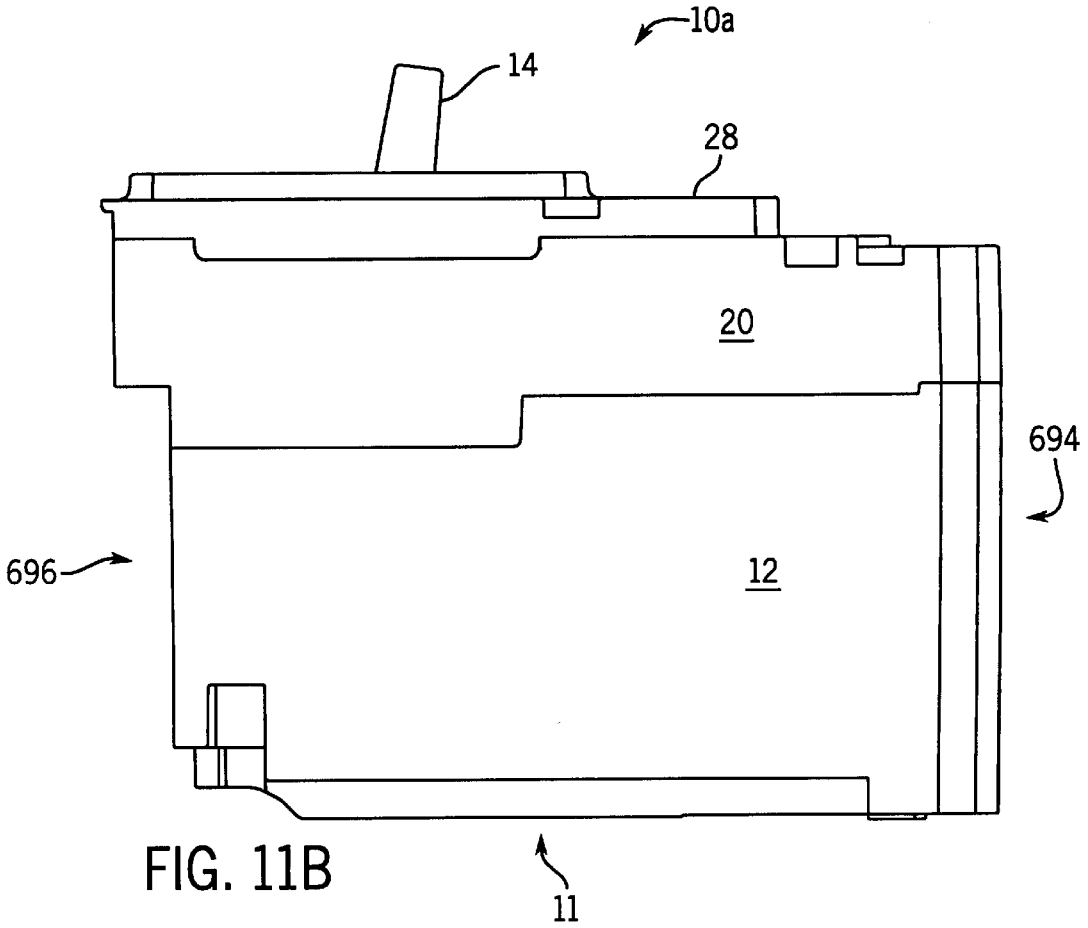
FIG. 11B is a side view of the frame portion of the circuit breaker shown in FIG. 10.

FIG. 11A shows trip unit 610. Base 612 receives cover 614, and stab 658 and dovetail 634 facilitate electrical and mechanical connection to breaker unit 11 (shown in FIGS. 10 and 11B). Trip unit latch 780 and trip bar pawl 782 are provided corresponding inclined surfaces for rotational positioning of trip bar 54 using thermal adjusting knob 714, as described above for another embodiment, which adjusts a gap (not shown) of a free end (not shown) of a bimetallic strip 62. Operation and calibration are in all respects generally similar to that described above for the foregoing embodiments.

While the embodiments illustrated in the figures and described above are presently preferred, it should be understood that these embodiments are offered by way of example only. Invention is not intended to be limited to any particular embodiment, but it is intended to extend to various modifications that nevertheless fall within the scope of the intended claims. For example, it is also contemplated that the solenoid can receive a control power signal from an electronic control circuit connected to the circuit breaker. Additionally, it is also contemplated that the trip mechanism having a bi-metal trip unit or an electronic trip unit with a load terminal be housed in a separate housing capable of mechanically and electrically connecting to another housing containing the operating mechanism and line terminal thereby providing for a quick and easy change of current ratings for an application of the circuit breaker contemplated herein. Other modifications will be evident to those with ordinary skill in the art.

What is claimed is:

1. An adjustable thermal-magnetic trip unit for a molded case circuit breaker, with the circuit breaker including a housing having an operating mechanism including an intermediate latch, a line terminal, a load terminal and a cover, the adjustable thermal-magnetic trip unit comprising:

a magnetic yoke mounted in the housing;

a bimetal member mounted in the magnetic yoke, with the bimetal member having a fixed end and a movable end, with the fixed end coupled to a load bus of the load terminal and the movable end coupled to a movable contact of the operating mechanism;

a trip bar extending along a horizontal axis and rotatably mounted in the housing, with the trip bar having an actuating arm positioned with a gap from the movable end of the bimetal member and with the actuating arm aligned to selectively engage the movable end of the bimetal member;

a latch pawl mounted on the trip bar, with the latch pawl having an inclined latching surface aligned with and engaging an inclined latch surface of the intermediate latch; and, an adjustment knob associated with the trip bar, with the adjustment knob having an eccentric pin aligned with a slot in the trip bar, wherein the rotation of the adjustment knob imparts a lateral position motion to the trip bar along the horizontal axis thereby moving the latch pawl along the inclined latching surface to change the gap between the actuating arm and the movable end of the bimetal member.

2. The adjustable thermal-magnetic trip unit of claim 1, further comprising at least each one additional magnetic yoke, bimetal member, and actuating arm aligned with the additional bimetal member configured in a multi-pole circuit breaker.

3. The adjustable thermal-magnetic trip unit of claim 1, wherein the latch pawl and trip bar are one piece.

4. The adjustable thermal-magnetic trip unit of claim 1, wherein the adjustment knob is accessible through the cover of the circuit breaker.

5. The adjustable thermal magnetic trip unit of claim 4, wherein the cover is provided with a through hole, with the through hole sized to receive the adjustable knob, with a retaining hook retained against the cover by a biasing member mounted in the through hole.

6. The adjustable thermal magnetic trip unit of claim 1, wherein the adjustable knob is not accessible through the cover of the circuit breaker and with the adjustable knob fixed in a selected position and retained in such position by a protrusion on the cover.

7. The adjustable thermal magnetic trip unit of claim 1, wherein the circuit breaker housing comprises at least two parts, with one part having the operating mechanism, intermediate latch, and line terminal, and another part having the load terminal and the adjustable thermal-magnetic trip unit, with the cover extending over each part.

8. The adjustable thermal magnetic trip unit of claim 7, wherein the two parts of the housing are selectively separable.

9. A molded case circuit breaker comprising:

a molded housing including a removable breaker cover;

a first terminal and a second terminal mounted in the case;

a contact electrically coupled to the first terminal;

a moveable contact electrically coupled to the second terminal;

an operating mechanism having a pivoting member moveable between an ON position, an OFF position and a TRIPPED position, wherein the pivoting member is coupled to the moveable contact;

an intermediate latching mechanism mounted in the housing and coupled to the operating mechanism; and, an adjustable thermal-magnetic trip unit comprising:

a magnetic yoke mounted in the housing;

a bimetal member mounted in the magnetic yoke, with the bimetal member having a fixed end and a movable end, with the fixed end coupled to a load bus of the second terminal and the movable end coupled to the movable contact of the operating mechanism;

a trip bar extending along a horizontal axis and rotatably mounted in the housing, with the trip bar having an actuating arm positioned with a gap from the movable end of the bimetal member and with the actuating arm aligned to selectively engage the movable end of the bimetal member;

a latch pawl mounted on the trip bar, with the latch pawl having an inclined latching surface aligned with the intermediate latch; and, an adjustment knob associated with the trip bar, with the adjustment knob having an eccentric pin aligned with a slot in the trip bar, wherein the rotation of the adjustment knob imparts a lateral position motion to the trip bar along the horizontal axis thereby moving the latch pawl along the inclined latching surface to change the gap between the actuating arm and the movable end of the bimetal member.

10. The circuit breaker of claim 9, further comprising at least each one additional magnetic yoke, bimetal member, and actuating arm aligned with the additional bimetal member configured in a multi-pole circuit breaker.

11. The circuit breaker of claim 9, wherein the latch pawl and trip bar are one piece.

12. The circuit breaker of claim 9, wherein the adjustment knob is accessible through the cover of the circuit breaker.

13. The circuit breaker of claim 12, wherein the cover is provided with a through hole, with the through hole sized to receive the adjustable knob, with a retaining hook retained against the cover by a biasing member mounted in the through hole.

14. The circuit breaker of claim 9, wherein the adjustable knob is not accessible through the cover of the circuit breaker and with the adjustable knob fixed in a selected position and retained in such position by a protrusion on the cover.

15. The circuit breaker of claim 9, wherein the circuit breaker housing comprises at least two parts, with one part having the operating mechanism, intermediate latch, and first terminal, and another part having the second terminal and the adjustable thermal-magnetic trip unit, with the cover extending over each part.

16. The circuit breaker of claim 15, wherein the two parts of the housing are selectively separable.

17. The circuit breaker of claim 9, further comprising:

an accessory socket formed in the breaker cover on either side of an opening for the pivoting member, with the accessory socket in communication with the housing and configured to accept a plurality of different types of accessories; and, an accessory cover sized to cover an accessory mounted in the accessory socket.

18. A circuit breaker comprising:

a housing including a base;

a means for connecting a load to the breaker, mounted in the housing;

a means for connecting an electrical line to the breaker, mounted in the housing;

a stationary contact electrically coupled to the means for connecting an electrical line;

a moveable contact coupled to a means for operating mounted in the housing and having a pivoting member moveable between an ON position and OFF position, and a TRIPPED position, with the pivoting member coupled to the moveable contact and with the means for operating coupled to an intermediate means for latching the means for operating;

a means for tripping coupled to the moveable contact and the means for connecting a load with the means for tripping in selective operative contact with the intermediate means for latching; and, a means for adjusting a characteristic of the means for tripping, with the means for adjusting having a latching pawl movable along an inclined latching surface, wherein the means for tripping will trip the circuit breaker.

19. The circuit breaker of claim 18, wherein the means for adjusting is accessible through a cover of the circuit breaker.

20. The circuit breaker of claim 19, wherein the cover is provided with a hole sized to receive the means for adjusting, with the means for adjusting retained in the hole by a means for retaining molded in the cover and a means for biasing pushing the means for adjusting against the means for retaining.

21. The circuit breaker of claim 18, wherein the means for adjusting is not accessible through the cover of the circuit breaker and with the means for adjusting fixed in a selected position and maintained in such position by a means for maintaining on the cover.

22. The circuit breaker of claim 21, wherein the means for maintaining is molded in the cover.

* * * * *